United States Patent [19]

Kempka

[11] 4,194,774

[45] Mar. 25, 1980

[54] GARBAGE CAN LOCK

[76] Inventor: Dorothy E. Kempka, 28305 SE. 61st St., Issaquah, Wash. 98027

[21] Appl. No.: 941,144

[22] Filed: Sep. 11, 1978

Related U.S. Application Data

[63] Continuation of Ser. No. 817,794, Jul. 21, 1977, abandoned.

[51] Int. Cl.[2] ..... E05C 13/02

[52] U.S. Cl. ..... 292/304; 292/202

[58] Field of Search ..... 292/304, 300, 302, 206, 292/DIG. 39, DIG. 40, 105, 202

[56] References Cited

U.S. PATENT DOCUMENTS

| | | | |
|---|---|---|---|
| 637,160 | 11/1899 | Richter | 292/105 X |
| 1,444,135 | 2/1923 | O'Connor | 292/304 X |
| 1,471,609 | 10/1923 | Jorgensen | 292/304 |
| 1,633,645 | 6/1927 | Molberg | 292/304 X |
| 1,677,234 | 7/1928 | Hayes | 292/304 X |
| 2,488,119 | 11/1949 | Ferris | 292/304 X |
| 2,722,444 | 11/1955 | Wexler | 292/304 X |

FOREIGN PATENT DOCUMENTS

| | | | |
|---|---|---|---|
| 904062 | 12/1943 | France | 292/304 |

*Primary Examiner*—Richard E. Moore
*Attorney, Agent, or Firm*—Dowrey & Cross

[57] ABSTRACT

A garbage can lock made of three parts of metal material, installed in two units, second unit is installed on the opposite side of the garbage can body and lid in a manner as the first unit; since the second unit is indentical to the first unit herein of this invention in construction, arrangement of parts and total, I am herewithin describing only one unit, with reference to this, a more detailed description of the installation of the two components herein will be described hereinafter.

1 Claim, 3 Drawing Figures

GARBAGE CAN LOCK

This is a continuation of application Ser. No. 817,794, July 21, 1977, now abandond.

My invention relates to new and useful improvements in a garbage can lock. It is distressing to garbage can owners to see the contents of their garbage cans strewn by animals over the ground. I have solved this problem by providing a new, positive garbage can lock which will deny the animals the access to the garbage can contents entirely by holding the garbage can lid in a positive locked position. With this in view, the invention consists in certain novel features of construction, combination and arrangement of parts to be hereinafter more fully described and claimed.

For a complete understanding of my invention, reference is to be had to the following description and accompanying drawing, in which:

FIG. 1 is a fragmentary view of a garbage can lid, a fragmentary view of a garbage can body and a perspective view of a complete garbage can lock. NOTE: Since the lock is composed of two identical units installed in the same manner on the opposite side of each other on the lid part of the garbage can, and on the body part of the garbage can, said units of the same construction and mechanism, I am describing herewithin one unit only.

Figure 1:
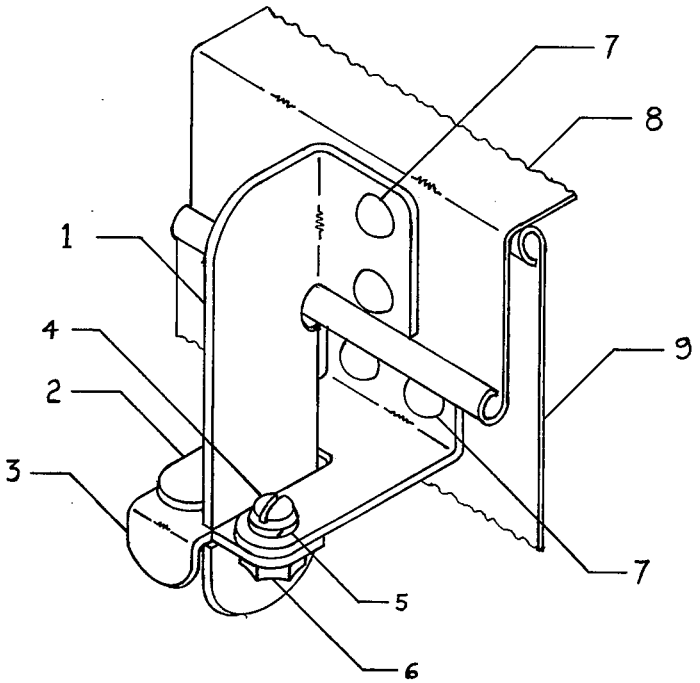
Figure 2:
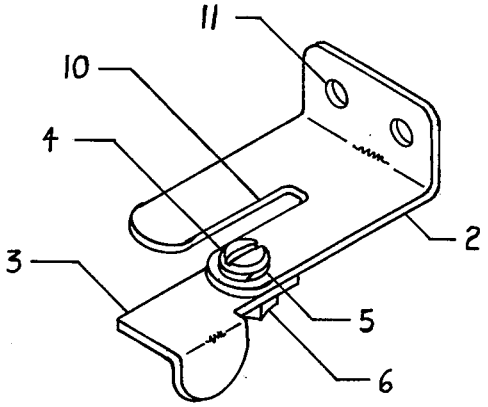
FIG. 2 is a perspective view of the lower part of the lock of the garbage can body.
Figure 3:
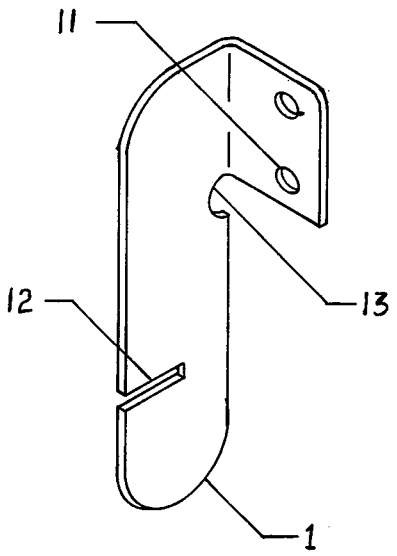
FIG. 3 is a perspective view of the upper part of the garbage can lid.

Referring to the drawings FIG. 1, 8, is a fragmentary view of the garbage can lid; 9, a fragmentary view of the garbage can body; 1, upper lock lid part with slot (FIG. 3; 12) 7, two rivets as shown holding the said part to the garbage can lid, passed through bores (FIG. 3; 11) and passed through matching bores in the said garbage can lid. 2, a lower lock can body part with slot (FIG. 2; 10) 3 a locking bar part with a bent finger catch. 4, a tension and holding bolt installed and passed through bores in the part (FIG. 2; 11) and through matching bores of the can body 9. 10, receiving slot for part (FIG. 3 and 1) 11, bores for passing of rivets 7, through the body of the garbage can,(FIG. 2 and 3) 12, receiving slot for locking bar 3, (FIG. 1 and 3) 13, radius slot to fit the rim of the garbage can lid. By inserting part of lock 1, into the slot 10, of part 2, and moving locking bar 3, into receiving slot 12, of part 1, the garbage can is in locked position. By reversing the said operation the garbage can is in an open position.

It is believed that the simplicity and advantages of this invention will be perfectly apparent to those skilled in the art to which such a device relates, and while I have herein set forth a satisfactory embodiment of the invention, it is to be understood that such changes therefrom as fairly fall within the scope of my claim may be resorted to when desired

I claim:

1. A lock for securing a closure member having a peripheral lip to an open ended container on which the closure member is positionable in a closure position in overlying relation with the container end opening with its lip telescopically overlapping a portion of the container adjacent the end opening thereof, the lock comprising: two members mounted on the closure member and container, respectively; and a locking element; one of said two members including two finger portions projecting outwardly and defining an open ended elongated receiving slot therebetween into which a portion of the other of said two members is insertable to restrain movement of the closure member with respect to the container in a direction transverse to the longitudinal axis of the container when the closure member is positioned in its closure position; the other of said two members including an elongated plate portion adapted to extend toward said two finger portions and through said receiving slot when said closure member is positioned in said closure position, said plate portion having an open ended transverse locking slot extending from its outer edge at an elevation immediately adjacent the sides of said two finger portions opposite the mounting for said other member; and said locking element including an elongated flat section mounted to said opposite side of one of said finger portions adjacent said receiving slot for movement into a locking position at which a portion of said flat section extends through the locking slot of said plate portion and into engagement with said opposite side of the other of said finger portions to secure said closure member to said container and to resist forces tending to separate said closure member from said container by bearing against said opposite sides of said finger portions, said locking element further including an outwardly exposed finger catch for movement of said flat section into and out of locking engagement with said plate portion, and said locking element including means mounting said flat section to said one finger portion in springloaded engagement such that said flat section bears against said finger portions and requires positive manual force to be applied to said finger catch to open said locking element.

* * * * *